US010307006B2

(12) United States Patent
Knoll

(10) Patent No.: US 10,307,006 B2
(45) Date of Patent: Jun. 4, 2019

(54) HOLSTER BEVERAGE HOLDER

(71) Applicant: James Knoll, Bushland, TX (US)

(72) Inventor: James Knoll, Bushland, TX (US)

( * ) Notice: Subject to any disclaimer, the term of this patent is extended or adjusted under 35 U.S.C. 154(b) by 0 days.

(21) Appl. No.: 15/263,317

(22) Filed: Sep. 12, 2016

(65) Prior Publication Data

US 2016/0374489 A1 Dec. 29, 2016

Related U.S. Application Data

(63) Continuation-in-part of application No. 29/491,091, filed on May 16, 2014, now Pat. No. Des. 740,618.

(60) Provisional application No. 62/216,715, filed on Sep. 10, 2015.

(51) Int. Cl.

| | |
|---|---|
| ***A47G 23/02*** | (2006.01) |
| ***A45F 5/02*** | (2006.01) |
| ***B67B 7/16*** | (2006.01) |
| ***A45F 5/10*** | (2006.01) |
| *B67B 7/40* | (2006.01) |

(52) U.S. Cl.

CPC ..... *A47G 23/0225* (2013.01); *A45F 5/021* (2013.01); *A45F 5/10* (2013.01); *A47G 23/0241* (2013.01); *A47G 23/0266* (2013.01); *B67B 7/16* (2013.01); *A45F 2005/026* (2013.01); *A45F 2005/1006* (2013.01); *A45F 2200/0583* (2013.01); *A47G 2200/10* (2013.01); *B67B 7/403* (2013.01)

(58) Field of Classification Search

CPC ..... A45F 2200/0583; A45F 5/021; A45F 2005/1006; A45F 2005/026; A47G 23/02; A47G 23/0208; A47G 23/0216; A47G 23/0225; A47G 23/0233; A47G 23/0241; A47G 23/0266; A47G 2200/10; B67B 7/16; B67B 7/403

USPC ..... 224/148.1, 148.7, 197; D3/229

See application file for complete search history.

(56) References Cited

U.S. PATENT DOCUMENTS

| | | | | | |
|---|---|---|---|---|---|
| 2,029,051 | A | * | 1/1936 | Blevins | A47G 23/0241 215/395 |
| D149,933 | S | * | 6/1948 | Bushman | 215/395 |
| D186,555 | S | * | 11/1959 | Hunt | 220/741 |
| 2,981,562 | A | * | 4/1961 | Long | A47G 23/0241 215/12.1 |
| D211,818 | S | * | 7/1968 | Massey | D7/622 |

(Continued)

*Primary Examiner* — Justin M Larson

(74) *Attorney, Agent, or Firm* — Shannon Warren

(57) ABSTRACT

A beverage holder configured for selectively holding a beverage is disclosed. Said beverage holder comprising a beverage containment comprising a base portion, an upper retainer portion and a handle portion. Said base portion and said upper retainer portion comprise a round sidewall having an internal diameter being larger than an external diameter of a beverage. Said base portion comprises a bottom surface configured to receive and hold a bottom portion of said beverage. Said upper retainer portion and said base portion are aligned along a vertical axis such that when said beverage is held within said beverage containment it is held upright along said vertical axis. Said upper retainer portion and said base portion are connected to one another with said handle portion. Said handle portion extends outward away from said vertical axis so as to enable a user to grip said beverage holder with said handle portion.

10 Claims, 15 Drawing Sheets

(56) References Cited

U.S. PATENT DOCUMENTS 3,979,011 A * 9/1976 Schleicher ..... A47G 23/0266 220/742
D283,578 S * 4/1986 Kawaguchi ..... D7/622
4,596,370 A * 6/1986 Adkins ..... B62J 11/00 224/414
D287,451 S * 12/1986 Schrock ..... D7/622
4,708,273 A * 11/1987 Grant ..... A45F 5/02 220/741
4,867,358 A * 9/1989 Bennis ..... A45F 3/16 224/148.3
4,993,611 A * 2/1991 Longo ..... A45F 5/00 220/737
D315,848 S * 4/1991 Guzman ..... 224/148.3
5,056,696 A * 10/1991 Lahr ..... A45F 5/02 224/148.4
5,232,137 A * 8/1993 Devine ..... A45F 5/02 222/175
5,456,436 A * 10/1995 Faudie ..... B60N 3/103 220/737
D367,413 S * 2/1996 Ballin ..... D10/46.2
D395,238 S * 6/1998 Freitas ..... D9/455
D395,825 S * 7/1998 Freitas ..... D9/455
6,045,017 A * 4/2000 Connell ..... A45F 5/02 224/148.4
6,062,380 A * 5/2000 Dorney ..... A47G 19/2227 206/217
6,193,202 B1 * 2/2001 Rogers ..... A47C 7/68 248/106
6,457,616 B2 * 10/2002 Gagne ..... A45F 3/16 224/148.4
6,557,738 B1 * 5/2003 Meintzer ..... A45F 5/00 224/148.7
D512,272 S * 12/2005 Avrish ..... D19/84
7,207,538 B2 * 4/2007 Kent-Fawkes ..... B65D 23/106 215/395
7,275,729 B2 * 10/2007 Sherman ..... A47G 25/08 224/148.7
D557,567 S * 12/2007 Gronikowski ..... D7/622
D559,629 S * 1/2008 Gifford, Jr. ..... D7/608
7,404,345 B1 * 7/2008 Dipprey ..... B67B 7/16 81/3.09
7,469,870 B2 * 12/2008 Brandin ..... B60N 3/101 224/277
7,527,310 B2 * 5/2009 Shaskey, Sr. ..... B65D 23/106 215/396
D593,859 S * 6/2009 Barnum ..... D7/622
D601,862 S * 10/2009 Welch ..... D7/607
7,685,908 B1 * 3/2010 Sebastian ..... A47G 23/0216 81/3.09
D615,366 S * 5/2010 Berezansky ..... D7/622
7,793,904 B2 * 9/2010 Scarton ..... A47G 23/0225 224/414
7,832,606 B2 * 11/2010 Sin ..... A45F 5/02 224/197
D636,232 S * 4/2011 McCarty ..... D7/619.1
D643,289 S * 8/2011 Harlan ..... D7/622
8,001,671 B2 * 8/2011 Mitchell ..... A47G 23/0225 220/737
8,066,148 B2 * 11/2011 Garahan ..... A45F 5/02 220/737
8,220,763 B2 * 7/2012 Lewis ..... A45F 5/00 224/328
8,245,600 B2 * 8/2012 Beard ..... A47G 23/0241 81/3.09
8,245,892 B2 * 8/2012 Kriner ..... A44B 11/005 224/148.4
8,333,300 B2 * 12/2012 Diaz ..... B44D 3/14 211/65
8,499,951 B1 * 8/2013 McDonald ..... B65D 23/106 215/395
8,608,019 B2 * 12/2013 Wren ..... A47G 23/0216 220/757
8,899,644 B2 * 12/2014 Hancey ..... A45F 5/10 215/396
D721,924 S * 2/2015 Trafton ..... D7/507
9,004,333 B2 * 4/2015 Monaco ..... A45C 11/00 206/320
9,027,807 B2 * 5/2015 Kampas ..... A45F 5/00 224/148.4
9,084,356 B2 * 7/2015 Fife ..... H04M 1/11
D740,077 S * 10/2015 Strepkoff ..... D7/622
D740,618 S * 10/2015 Knoll ..... D7/622
9,149,139 B1 * 10/2015 Rogers ..... A47G 23/02
D765,469 S * 9/2016 Hill ..... D7/394
D766,035 S * 9/2016 Cox ..... D7/394
D799,279 S * 10/2017 McGraw ..... D7/622
D812,988 S * 3/2018 Seiders ..... D7/622
D812,989 S * 3/2018 Seiders ..... D7/622
9,919,843 B2 * 3/2018 Pulst ..... B65D 25/2829
D820,046 S * 6/2018 Seiders ..... D7/533
D825,178 S * 8/2018 Knoll ..... D3/229
2002/0175169 A1 * 11/2002 Tham-itthisak .... A47G 19/2205 220/600
2005/0056655 A1 * 3/2005 Gary ..... A47G 19/2261 220/737
2006/0016294 A1 * 1/2006 McGrath ..... A47G 23/0216 81/3.09
2007/0012140 A1 * 1/2007 Howlett ..... A47G 23/0216 81/3.09
2008/0047986 A1 * 2/2008 Will ..... A45F 5/02 224/148.3
2008/0054030 A1 * 3/2008 Diaz ..... B44D 3/14 224/148.7
2008/0060479 A1 * 3/2008 Nelson ..... B67B 7/16 81/3.09
2009/0255941 A1 * 10/2009 Kuntz ..... B65D 23/0885 220/592.17
2010/0294816 A1 * 11/2010 Sentell ..... A45F 5/02 224/148.3
2011/0233354 A1 * 9/2011 Mitchell ..... A47G 23/0225 248/206.5
2011/0303808 A1 * 12/2011 Bileth ..... A47G 23/0266 248/206.5
2012/0187138 A1 * 7/2012 Vasquez ..... A45C 1/02 220/739
2013/0334237 A1 * 12/2013 Priest ..... B65D 23/12 220/739
2015/0041427 A1 * 2/2015 Taw ..... B65D 23/106 215/396
2015/0305170 A1 * 10/2015 Fife ..... H04M 1/11 224/191
2016/0075480 A1 * 3/2016 Pulst ..... B65D 25/2829 220/755
2016/0374489 A1 * 12/2016 Knoll ..... A47G 23/0225 220/741
2018/0008072 A1 * 1/2018 Paige ..... A47G 23/0241

* cited by examiner

HOLSTER BEVERAGE HOLDER

CROSS-REFERENCE TO RELATED APPLICATIONS

This application claims benefit to U.S. patent application Ser. Nos. 29/491,091 filed on May 16, 2014 and 62/216,715 filed on Sep. 10, 2015.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

One example of a beverage holder can be found at U.S. Ser. No. 11/843,143. No other prior art is known to the Applicant.

None of the known inventions and patents, taken either singularly or in combination, is seen to describe the instant disclosure as claimed.

BRIEF SUMMARY OF THE INVENTION

A beverage holder configured for selectively holding a beverage is disclosed. Said beverage holder comprising a beverage containment comprising a base portion, an upper retainer portion and a handle portion. Said base portion and said upper retainer portion comprise a round sidewall having an internal diameter being larger than an external diameter of a beverage. Said base portion comprises a bottom surface configured to receive and hold a bottom portion of said beverage. Said upper retainer portion and said base portion are aligned along a vertical axis such that when said beverage is held within said beverage containment it is held upright along said vertical axis. Said upper retainer portion and said base portion are connected to one another with said handle portion. Said handle portion extends outward away from said vertical axis so as to enable a user to grip said beverage holder with said handle portion.

Next, a beverage holder is disclosed. Wherein, said beverage holder is configured to selectively hold a beverage. Said beverage holder further comprises a twist-off socket. Said twist-off socket is round-shaped and comprises an internal diameter being substantially similar to an external diameter of a cap of said beverage. Said twist-off socket is configured to receive and remove a cap from said beverages by: inserting a portion of said cap into said twist-off socket, turning said beverage around a vertical axis so as to loosen said cap from said beverage, preventing said cap from turning with said beverage, and removing said cap from said beverage.

Finally, a beverage holder is disclosed comprising a beverage containment. Said beverage holder comprises a one or more magnets configured to selectively attach said beverage holder to a ferromagnetic surface.

DETAILED DESCRIPTION OF THE INVENTION

Figure 1:
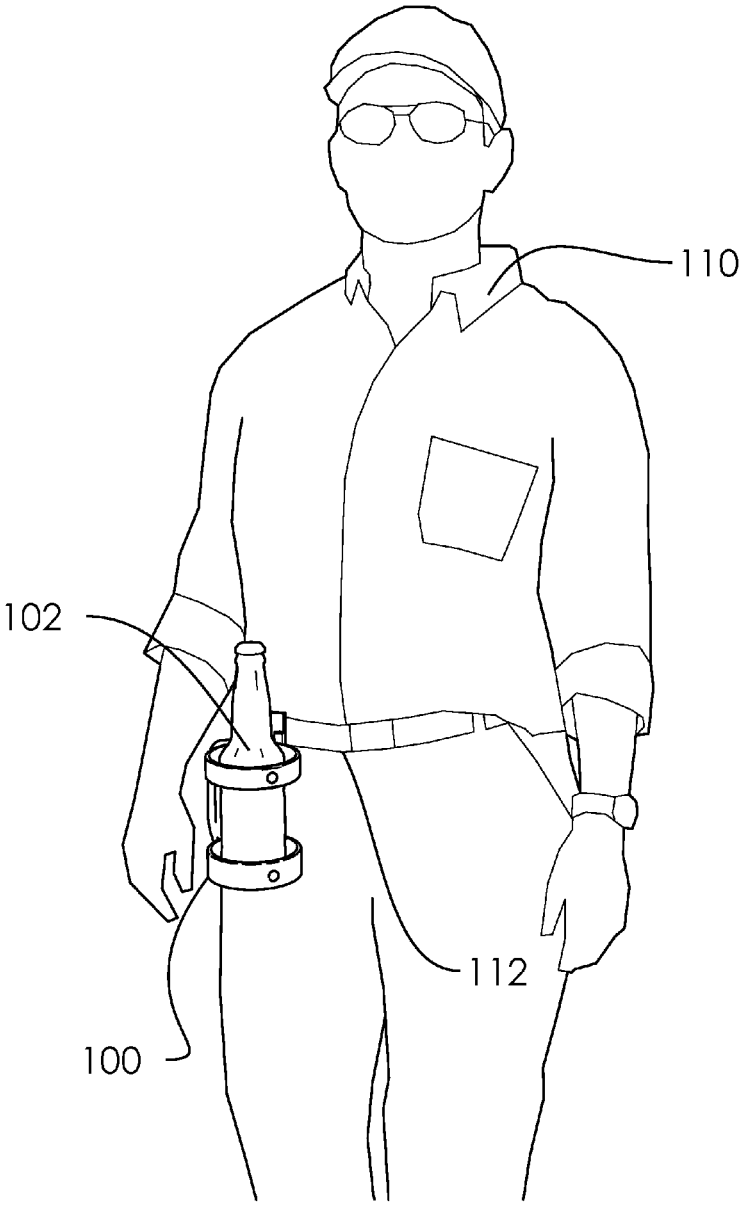
FIG. 1 illustrates a perspective overview view of a beverage holder 100 with a user 110.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a beverage holder 100
a bottle 102
an user 110
a belt 112
a beverage containment 200
a can 202
a base portion 204
an upper retainer portion 206
a handle portion 208
a beverages 222
a can tab 224
a cap 226
a center aperture 228
a bottom surface 230
a clip button 310
a drain aperture 312
a twist-off socket 314
a bottom surface 316
a rim portion 318
a lower surface 320
an indention 322
a vertical axis 324
a first end 326
a second end 328
an internal diameter 402
a height 404
an external diameter 406
a width 408
a clip 500
a holster 502
a belt clip 504
a first holster side 506*a*
a second holster side 506*b*
a release trigger 508
a stopper 510
a back portion 520
a passageway 522
a pry plate 602
a one or more magnets 604
a first magnet 604*a*
a second magnet 604*b*
a back 702
a front 704
a one or more sides 706
a first side 706*a*
a second side 706*b*
a grab 902
a one or more cap teeth 904
a raised lower rim 906
an internal diameter 908
an external diameter 910
a first end 1004*a*
a second end 1004*b*
a beverage containment 1200
a one or more sockets 1202
a first socket 1202*a*
a second socket 1202*b*
a one or more magnets 1204
a first magnet 1204*a*
a second magnet 1204*b*
a wall 1400

FIG. 1 illustrates a perspective overview view of a beverage holder 100 with a user 110.

In one embodiment, said beverage holder 100 can attach to said belt 112 for the storage and keeping of a beverage, such as said bottle 102. Meanwhile, said user 110 can keep his hands free.

In one embodiment, said bottle 102 can attach to said user 110 without said belt 112 by clipping on a waistband.

Figure 2A:
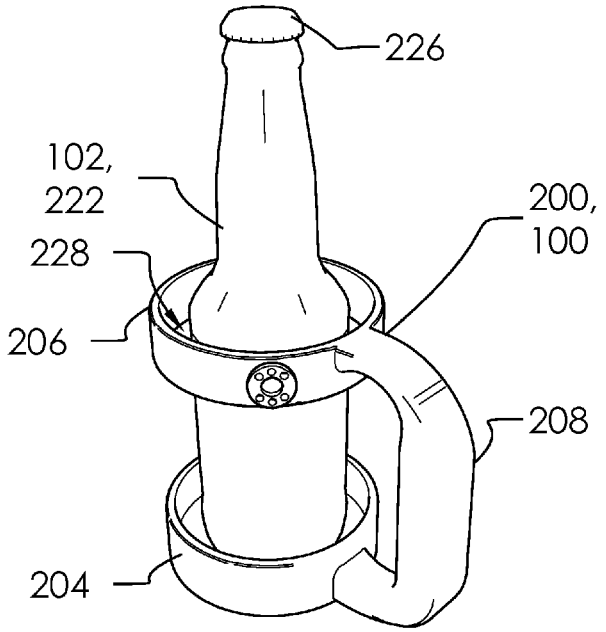
FIG. 2A illustrates a perspective overview view of a beverage holder 100 with said bottle 102.

FIG. 2A illustrates a perspective overview view of a beverage holder 100 with said bottle 102.

Figure 2B:
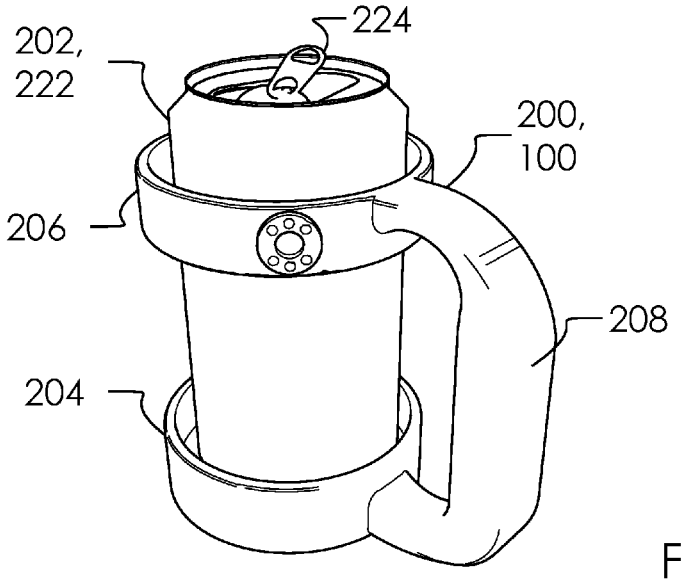
FIG. 2B illustrates a perspective overview view of a beverage holder 100 with a can 202.

FIG. 2B illustrates a perspective overview view of a beverage holder 100 with a can 202.

In one embodiment, said can 202 can comprise said can tab 224.

In one embodiment, said beverages 222 can comprise said can 202.

In one embodiment, said beverage containment 200 can comprise said base portion 204, said upper retainer portion 206, said handle portion 208, said center aperture 228 and said bottom surface 230.

In one embodiment, said base portion 204 can comprise said bottom surface 230.

In one embodiment, said beverage holder 100 can comprise said beverage containment 200, said base portion 204, said upper retainer portion 206 and said handle portion 208.

In one embodiment, said bottle 102 can comprise said cap 226.

In one embodiment, said beverage holder 100 can comprise a container portion 200 configured to selectively hold a beverages 222.

In one embodiment, said can 202 can comprise said can tab 224, and said bottle 102 can comprise a bottle cap 226.

Said beverage containment 200 can comprise a frame or holder for said beverages 222. In one embodiment, said beverage holder 100 can function like a mug when holding said beverages 222, as illustrated and well-known. However, said beverage holder 100 can provide other features as disclosed herein.

Although illustrated as loosely fitting around said beverages 222, said beverage containment 200 can be configured to either snuggly fit around said beverages 222, or otherwise, provide a springing mechanism for holding said beverages 222 within said upper retainer portion 206 and/or said base portion 204, such as done with many car cup holders.

In one embodiment, said base portion and said upper retainer portion comprise a round sidewall having an internal diameter being larger than an external diameter of a beverage.

In one embodiment, said handle portion extends outward away from said vertical axis so as to enable a user to grip said beverage holder with said handle portion. In one embodiment, said handle portion 208 can comprise a "C" shape with a first end 326 attached to said upper retainer portion 206 and a second end 328 attached to said base portion 204.

Said drain aperture 312 can drain fluids from within said beverage containment 200. It can also be used to access a cap 226 captured in said twist-off socket 314.

Figure 3A:
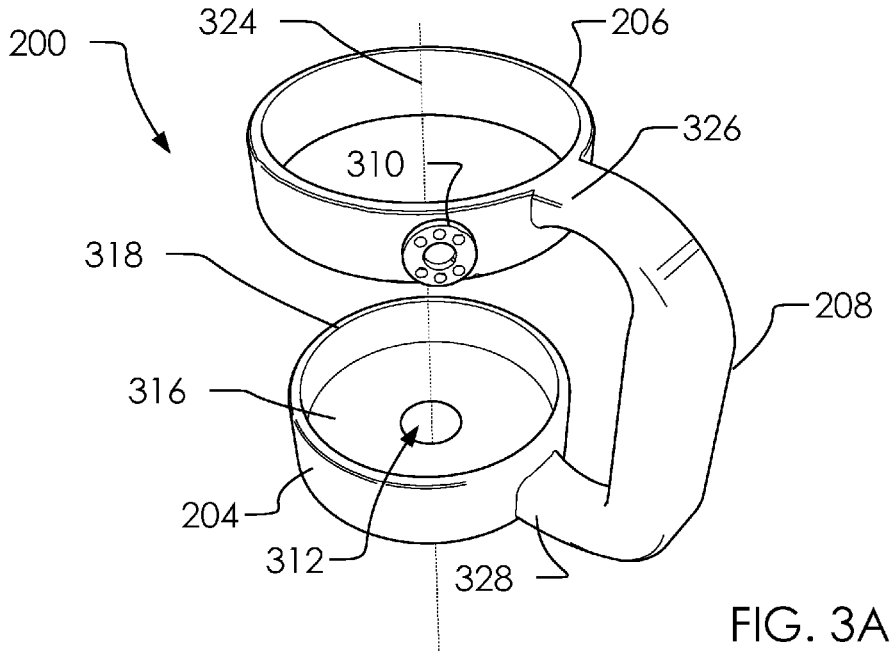
FIG. 3A illustrates a perspective overview view of a beverage containment 200.

FIG. 3A illustrates a perspective overview view of a beverage containment 200.

Figure 3B:
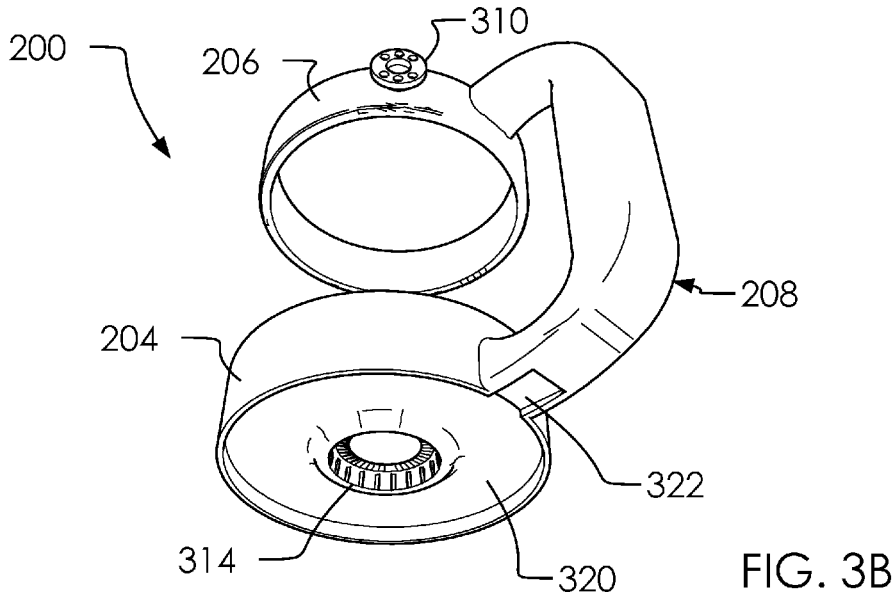
FIG. 3B illustrates a perspective bottom side view of a beverage containment 200.

FIG. 3B illustrates a perspective bottom side view of a beverage containment 200.

In one embodiment, said beverage holder 100 can comprise said clip button 310, said drain aperture 312 and said twist-off socket 314.

In one embodiment, said beverage containment 200 can comprise a one or more magnet apertures (which can comprise a first magnet aperture 302 and a second magnet aperture 304), said clip button 310, said drain aperture 312 and said twist-off socket 314.

In one embodiment, said base portion 204 can comprise said drain aperture 312, said twist-off socket 314, said bottom surface 316, said rim portion 318, said lower surface 320 and said indention 322.

In one embodiment, said upper retainer portion 206 can comprise said clip button 310.

Said container portion 200 can comprise a portion of said beverage holder 100 configured to hold said beverages 222. In one embodiment, said container portion 200 can be configured to hold said beverages 222 by receiving a portion of said beverages 222 through said upper retainer portion 206, and resting a portion of said beverages 222 on said base portion 204. Accordingly, said upper retainer portion 206 and said base portion 204 can hold said beverages 222 from substantial lateral movement and said beverages 222 can rest upon said base portion 204 so as to prevent it from falling completely through said container portion 200.

In one embodiment, said base portion 204 and said upper retainer portion 206 can be attached to one another with said handle portion 208. In this manner, said container portion 200 can be formed in the shape of a large mug, with an easy to grip handle (said handle portion 208) at one side and a cold beverage in a central portion.

In one embodiment, said bottom surface 316 can be substantially horizontal so as to provide a level surface for receiving said beverages 222. Said rim portion 318 can be arranged substantially perpendicular to said bottom surface 316, so as to provide a barrier around a circumference of said base portion 204. In one embodiment, said twist-off socket 314 can be an indention in said lower surface 320 of said bottom surface 316.

In one embodiment, a portion of said handle portion 208 can comprise an indention 322 with characteristics to be discussed below.

In one embodiment, said bottom surface 316 can be configured to receive and hold a bottom portion of said beverage.

Said beverage containment 200 can comprise said vertical axis 324. In one embodiment, said upper retainer portion 206 and said base portion 204 are aligned along said vertical axis 324 such that when said beverage is held within said beverage containment 200 it is held upright along said vertical axis 324.

In one embodiment, said twist-off socket 314 is configured to receive and remove a cap from said beverages by: inserting a portion of said cap into said twist-off socket, turning said beverage around said vertical axis so as to loosen said cap from said beverage, preventing said cap from turning with said beverage, and removing said cap from said beverage.

Figure 4A:
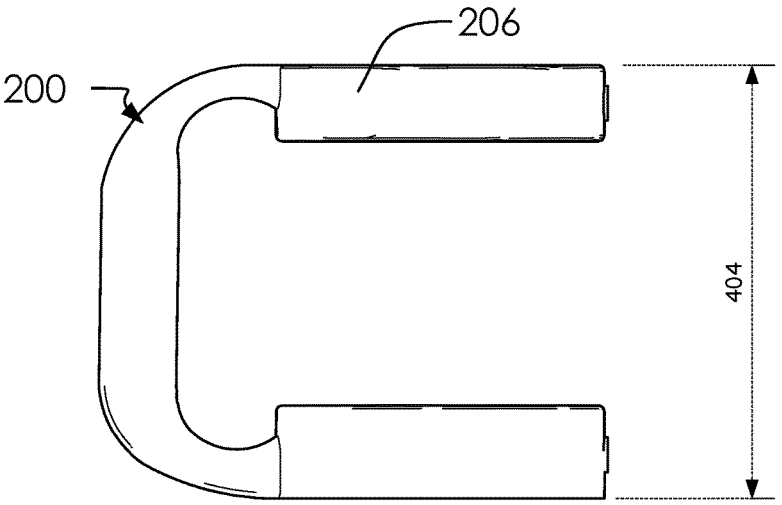
FIG. 4A illustrates an elevated front side view of a beverage containment 200.

FIG. 4A illustrates an elevated front side view of a beverage containment 200.

Figure 4B:
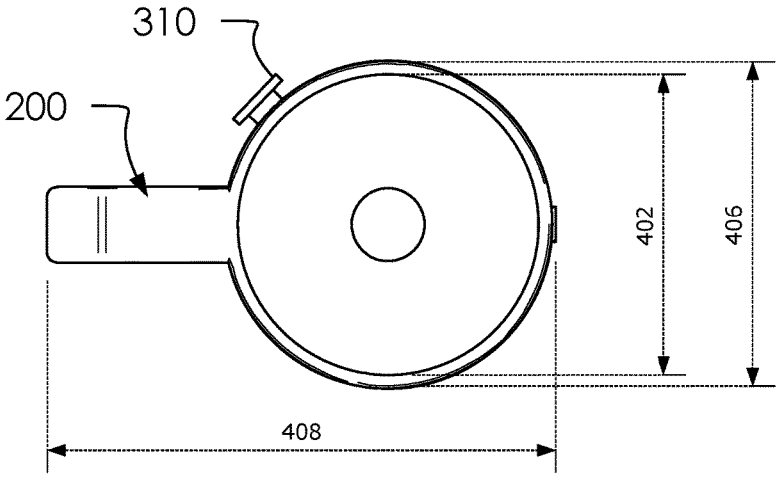
FIG. 4B illustrates an elevated top side view of a beverage containment 200.

FIG. 4B illustrates an elevated top side view of a beverage containment 200.

In one embodiment, said beverage containment 200 can comprise said height 404, said external diameter 406 and said width 408.

In one embodiment, said base portion 204 can comprise said internal diameter 402.

In one embodiment, said upper retainer portion 206 can comprise said internal diameter 402.

Figure 5A:
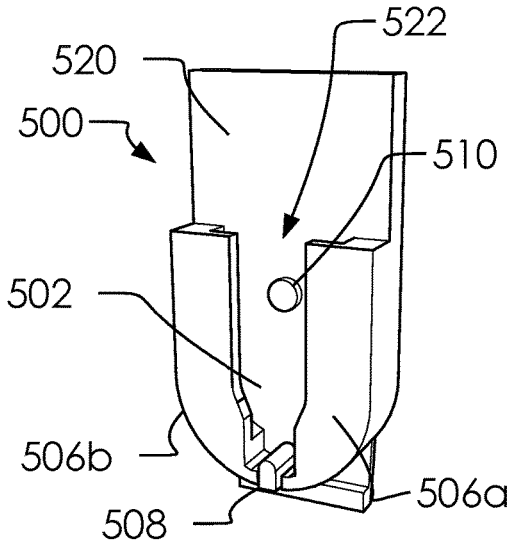
FIG. 5A illustrates a perspective overview view of a clip 500.

FIG. 5A illustrates a perspective overview view of a clip 500.

Figure 5B:
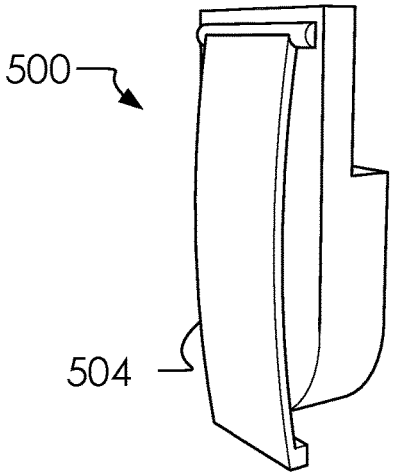
FIG. 5B illustrates a perspective back side view of a clip 500.

FIG. 5B illustrates a perspective back side view of a clip 500.

Figure 5C:
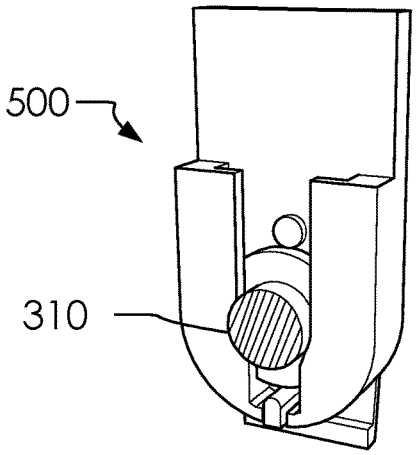
FIG. 5C illustrates a perspective front side view of a clip 500 with a cross-section view of said clip button 310.

FIG. 5C illustrates a perspective front side view of a clip 500 with a cross-section view of said clip button 310.

In one embodiment, said clip 500 can comprise said holster 502, said belt clip 504, said first holster side 506*a*, said second holster side 506*b*, said release trigger 508, said stopper 510, said back portion 520 and said passageway 522.

In one embodiment, said beverage holder 100 can comprise said clip 500.

In one embodiment, said holster 502 can comprise said first holster side 506*a*, said second holster side 506*b*.

In one embodiment, pressing said release trigger 508 can cause said stopper 510 to retract into said back portion 520 of said clip 500, so as to clear a passageway 522 to insert and remove said clip button 310 of said container portion 200 of said beverage holder 100, as is known in the art.

For example, as illustrated in FIG. 5C, with said stopper 510 extending out: said clip button 310 can be trapped between said first holster side 506*a*, said second holster side 506*b*, said back portion 520 and said stopper 510.

In one embodiment, said clip is configured to selectively attach to an object and allows said beverage holder to selectively attach to said object; and said beverage holder is configured to pivot on said clip button with said clip while attached to a user with said clip. Likewise, said clip comprises a belt clip configured to selectively attach to a belt of a user and thereby selectively hold said beverage holder to said belt of said user.

Figure 6A:
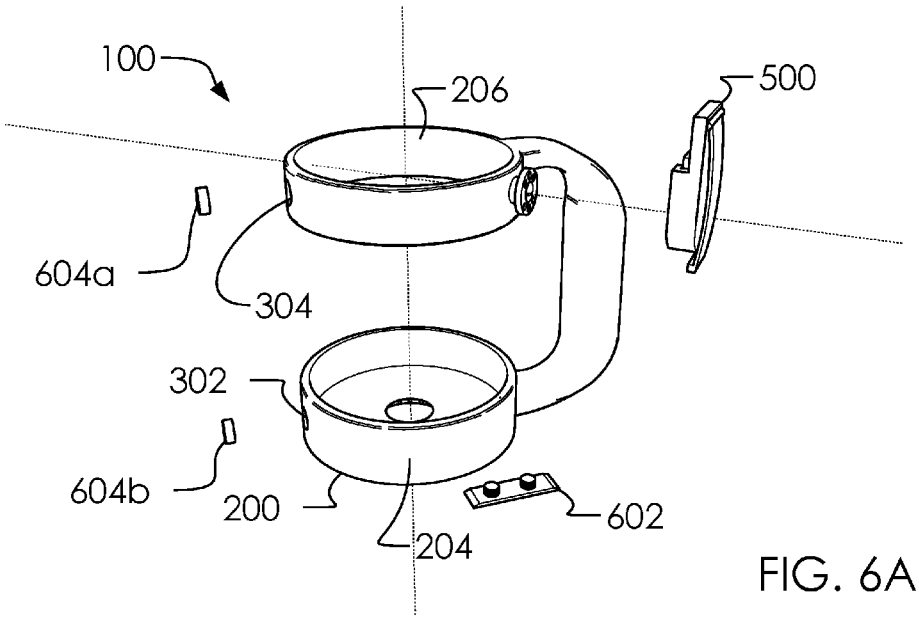
FIG. 6A illustrates a perspective overview view of a beverage holder 100 exploded.

FIG. 6A illustrates a perspective overview view of a beverage holder 100 exploded.

Figure 6B:
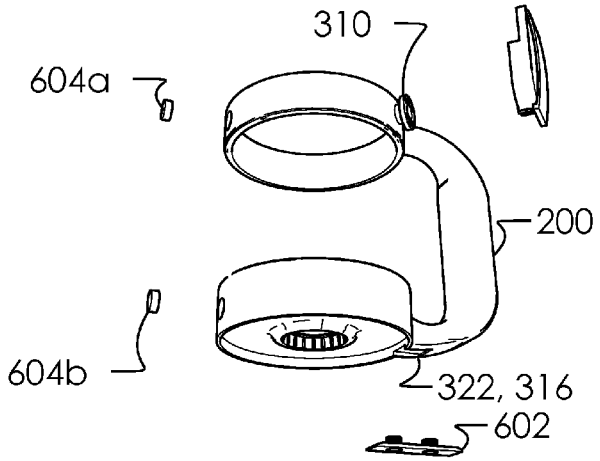
FIG. 6B illustrates a perspective bottom side view of a beverage holder 100 exploded.

FIG. 6B illustrates a perspective bottom side view of a beverage holder 100 exploded.

In one embodiment, said one or more magnets 604 can comprise said first magnet 604*a* and said second magnet 604*b*.

In one embodiment, said beverage holder 100 can comprise said pry plate 602, said one or more magnets 604, said first magnet 604*a* and said second magnet 604*b*.

In one embodiment, said beverage containment 200 can comprise said one or more magnets 604.

In one embodiment, said beverage holder 100 can comprise a one or more additional items which can be selectively attached to said container portion 200, such as through said lower accessory aperture 302 and said upper accessory aperture 304. As illustrated, said beverage holder 100 can comprise said one or more magnets 604 which enable said beverage holder 100 to selectively be selectively attached to a ferromagnetic material. For example, in one embodiment, said first magnet 604*a* and said second magnet 604*b* can be held near a metallic material and thereby attach said/100 to that material, as is known in the art.

Said pry plate 602 is described below in more detail, note however, that said pry plate 602 can be attached to said bottom surface 316 at said indention 322.

Figure 7A:
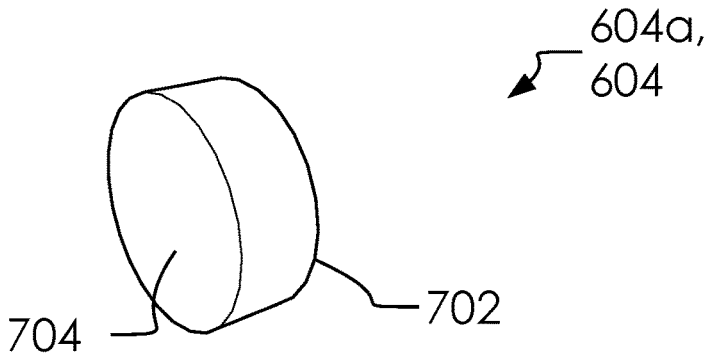
FIG. 7A illustrates a perspective overview view of a one or more magnets 604.

FIG. 7A illustrates a perspective overview view of a one or more magnets 604.

Figure 7B:
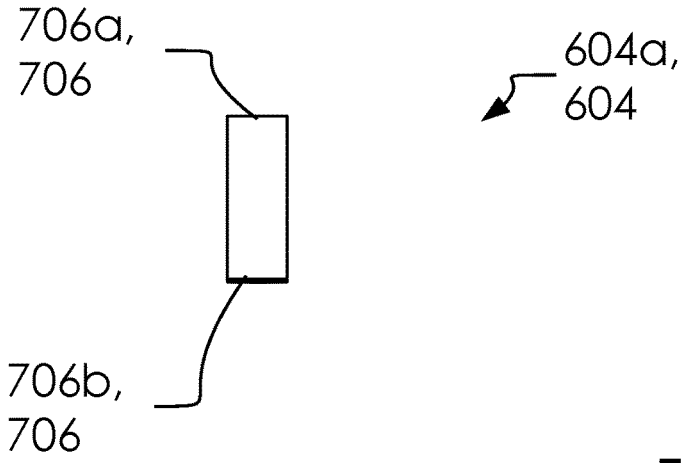
FIG. 7B illustrates an elevated top side view of a one or more magnets 604.

FIG. 7B illustrates an elevated top side view of a one or more magnets 604.

In one embodiment, said one or more sides 706 can comprise said first side 706*a* and said second side 706*b*.

In one embodiment, said one or more magnets 604 can comprise said back 702, said front 704 and said one or more sides 706.

In one embodiment, said one or more magnets 604 can comprise a magnetic portion such as said back 702. In another embodiment, said one or more magnets 604 can comprise a magnet all the way through.

In one embodiment, said one or more magnets 604 can be cylindrical objects being flat on said back 702 and said 704, and round on said one or more sides 706.

Said one or more magnets 604 can slide into said 302/and said 304/and be held to said beverage containment 200 with tension, mechanical means and/or adhesive. Adhesive can be a preferred embodiment.

Figure 8:
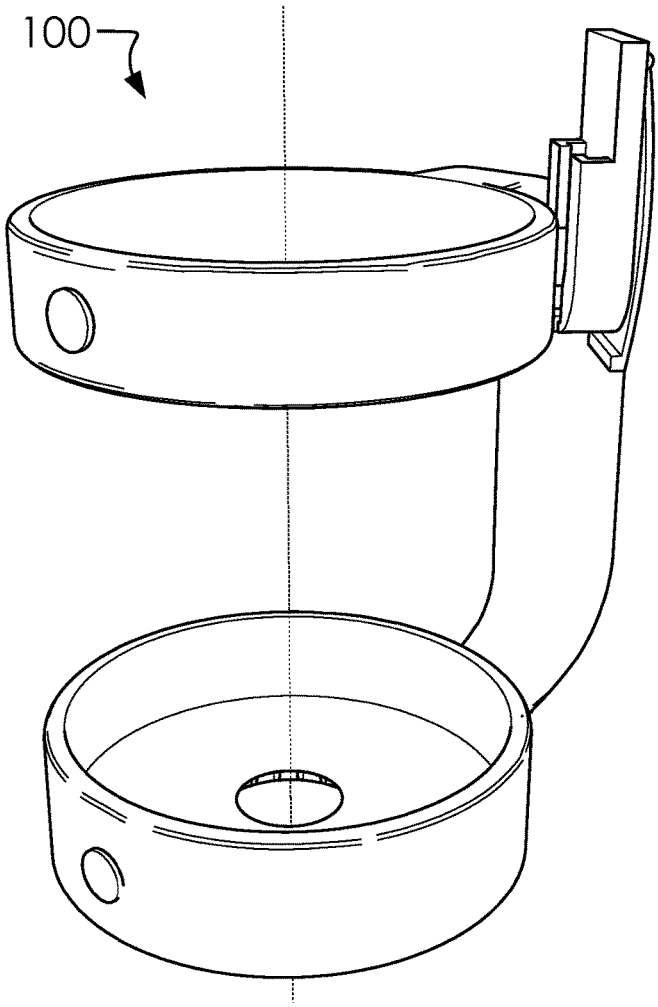
FIG. 8 illustrates a perspective overview view of a beverage holder 100.

FIG. 8 illustrates a perspective overview view of a beverage holder 100.

Figure 9A:
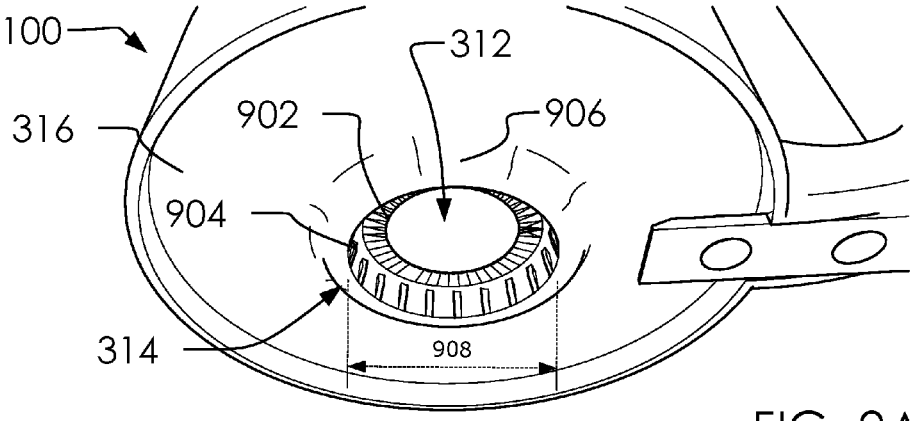
FIG. 9A illustrates a perspective bottom side view of a beverage containment 200.

FIG. 9A illustrates a perspective bottom side view of a beverage containment 200.

Figure 9B:
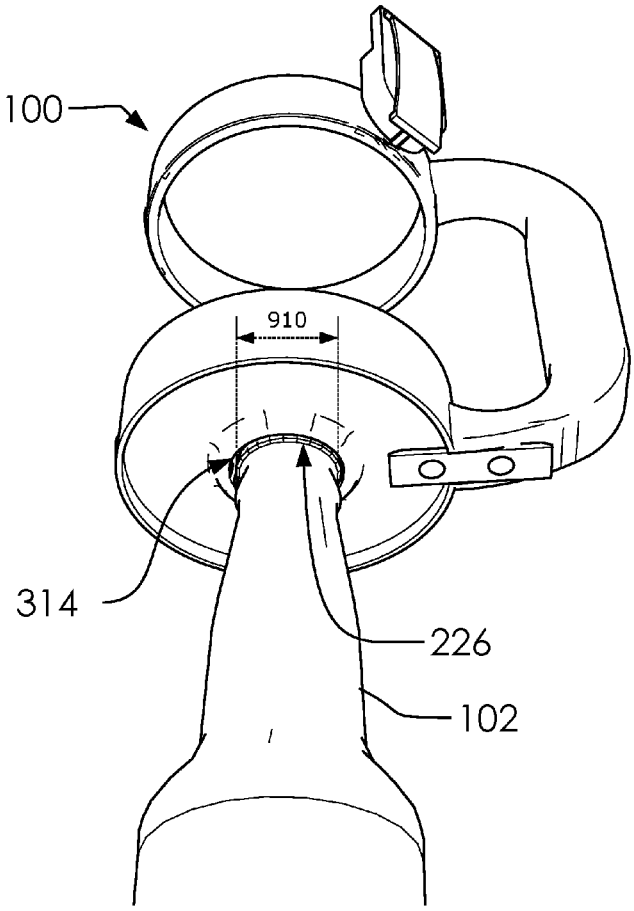
FIG. 9B illustrates a perspective bottom side view of a beverage containment 200 with said bottle 102.

FIG. 9B illustrates a perspective bottom side view of a beverage containment 200 with said bottle 102.

In one embodiment, said grab 902 can comprise said one or more cap teeth 904, said raised lower rim 906, said internal diameter 908 and said external diameter 910.

In one embodiment, said drain aperture 312 can comprise said grab 902.

In one embodiment, said twist-off socket 314 can comprise said grab 902, said one or more cap teeth 904, said raised lower rim 906 and said internal diameter 908.

In one embodiment, said cap 226 can comprise said external diameter 910.

In one embodiment, said raised lower rim 906 can be configured to create an indention in said bottom surface 316. In one embodiment, said raised lower rim 906 can comprise said internal diameter 908.

In one embodiment, said external diameter 910 of said bottle cap 226 is smaller than said internal diameter 908, so that said bottle cap 226 of said bottle 102 can selectively slide into said twist-off socket 314.

In one embodiment, said one or more cap teeth 904 can surround and grip side portions of said bottle cap 226 with said bottle cap 226 in said twist-off socket 314. In one embodiment, said beverage holder 100 can remove said bottle cap 226 from said bottle 102 by: inserting said bottle cap 226 into said twist-off socket 314; twisting said bottle 102 and said container portion 200 in opposite directions; and releasing said bottle cap 226 from said bottle 102. In one embodiment, said bottle cap 226 can be removed from said bottle 102 by twisting said bottle cap 226 counterclockwise, as is known in the art. Of course, this procedure presumes that said bottle cap 226 is that of a twist off variety, rather than a pry-off variety.

In one embodiment, said grab 902 within said twist-off socket 314 can hold said bottle cap 226 after it has been removed from said bottle 102. This functionality is cable of minimizing litter by minimizing accidental discarding of said bottle cap 226 after removal from said bottle 102. In one embodiment, said grab 902 can be magnetized to hold said cap 226 after removal from said bottle 102.

In one embodiment, said drain aperture 312 can allow a user to push said bottle cap 226 out of said twist-off socket 314 (by breaking an attraction force between said grab 902 and said bottle cap 226) from above said bottom surface 316.

In one embodiment, a magnet is required in said grab 902; wherein, said one or more cap teeth 904 can capture said cap 226 by gripping a portion of said cap 226 with said one or more cap teeth 904. In one embodiment, said cap 226 can be selectively held by said one or more magnets 604. In one embodiment, said cap 226 can be stuck to said one or more magnets 604 for storage after removal from said bottle 102.

In one embodiment, said twist-off socket further comprises a raised lower rim configured to surround said cap and press a portion of a one or more cap teeth into said cap. Said twist-off socket 314 can be located in a bottom surface of said beverage holder 100.

Figure 10:
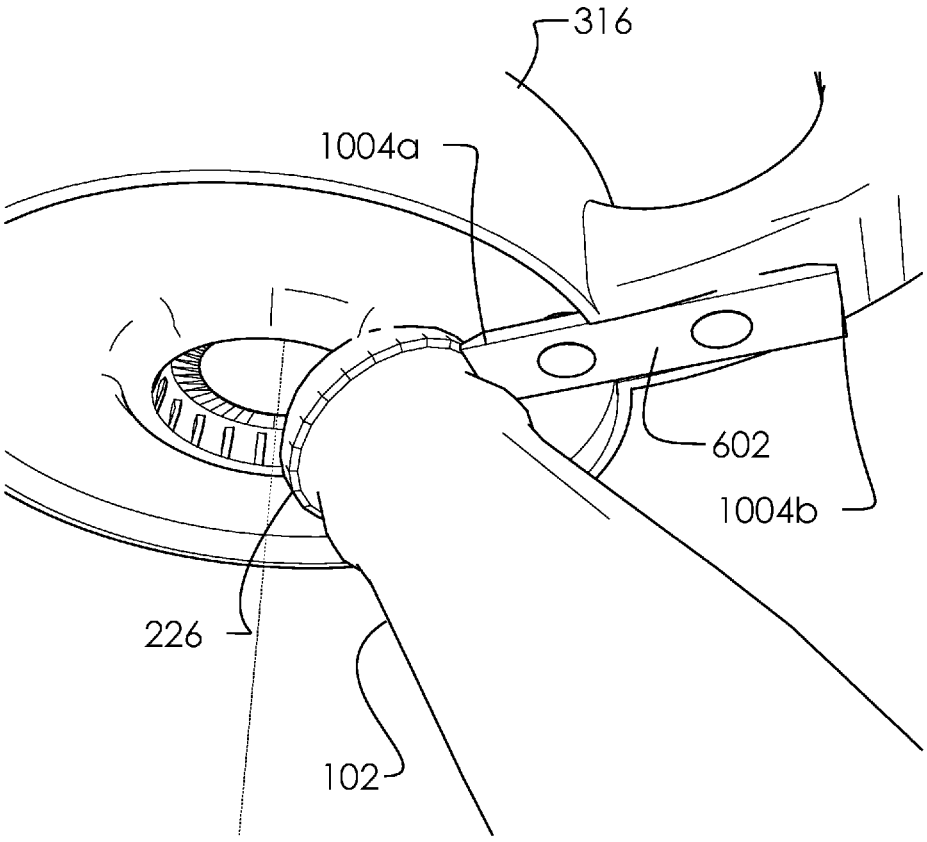
FIG. 10 illustrates a perspective bottom side view of a beverage containment 200 with a portion of said bottle 102 under a portion of said pry plate 602.

FIG. 10 illustrates a perspective bottom side view of a beverage containment 200 with a portion of said bottle 102 under a portion of said pry plate 602.

In one embodiment, said pry plate 602 can comprise said first end 1004*a* and said second end 1004*b*.

In one embodiment, said pry plate 602 can comprise said first end 1004*a*, said second end 1004*b*. In one embodiment, where said bottle cap 226 is of a pry-off variety, rather than the twist off variety discussed above, twisting said bottle cap 226 will not be as effective as more traditional prying methods. Accordingly, in one embodiment, said beverage holder 100 can comprise said pry plate 602 attached to said bottom surface 316 with said first end 1004*a* and/or said second end 1004*b* exposed for the purpose of prying off said bottle cap 226. In one embodiment, said first end 1004*a* can be pointing inward toward said twist-off socket 314 so that a portion of said bottle cap 226 can attach to said pry plate 602 and another portion thereof can press against said bottom surface 316, so as to provide ample prying ability.

Figure 11:
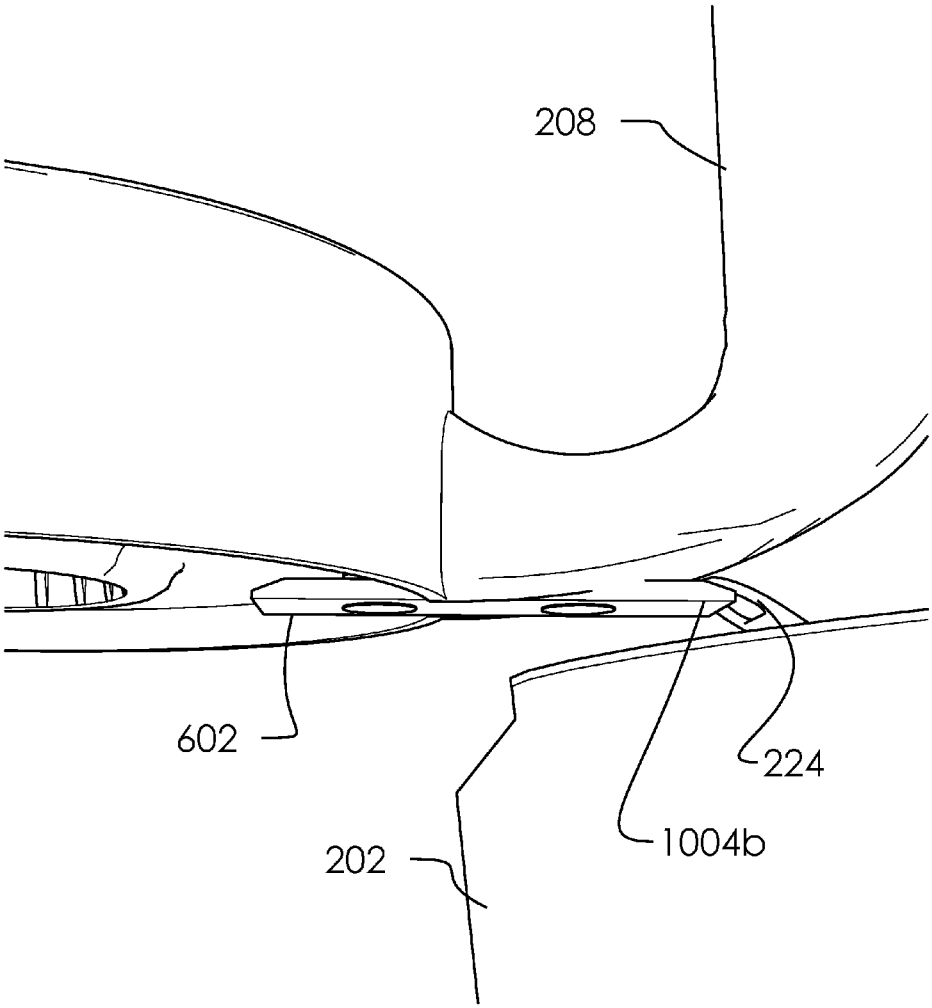
FIG. 11 illustrates a perspective bottom side view of a beverage containment 200.

FIG. 11 illustrates a perspective bottom side view of a beverage containment 200.

In one embodiment, said pry plate 602 can be used to open said can tab 224 of said can 202, as illustrated. For example, in one embodiment, said second end 1004*b* can face outward for easy access and said can tab 224 can be reached with said second end 1004*b* and pried open, as illustrated. In one embodiment, a portion of said handle portion 208 can be conveniently out of the way for this procedure because said second end 1004*b* can face outward under said handle portion 208 where said handle portion 208 curves up and out of the way. In one embodiment, said can tab 224 can fit under said bottom surface 316 and be pulled up with said first end 1004*a*, although this is not illustrated.

In one embodiment, said pry plate is located in a lower portion of said beverage containment; and said pry plate is configured to receive a portion of a cap or a can tab of said beverage and enable a user to pry open said beverage. In one embodiment, said pry plate is attached below said handle portion.

Figure 12:
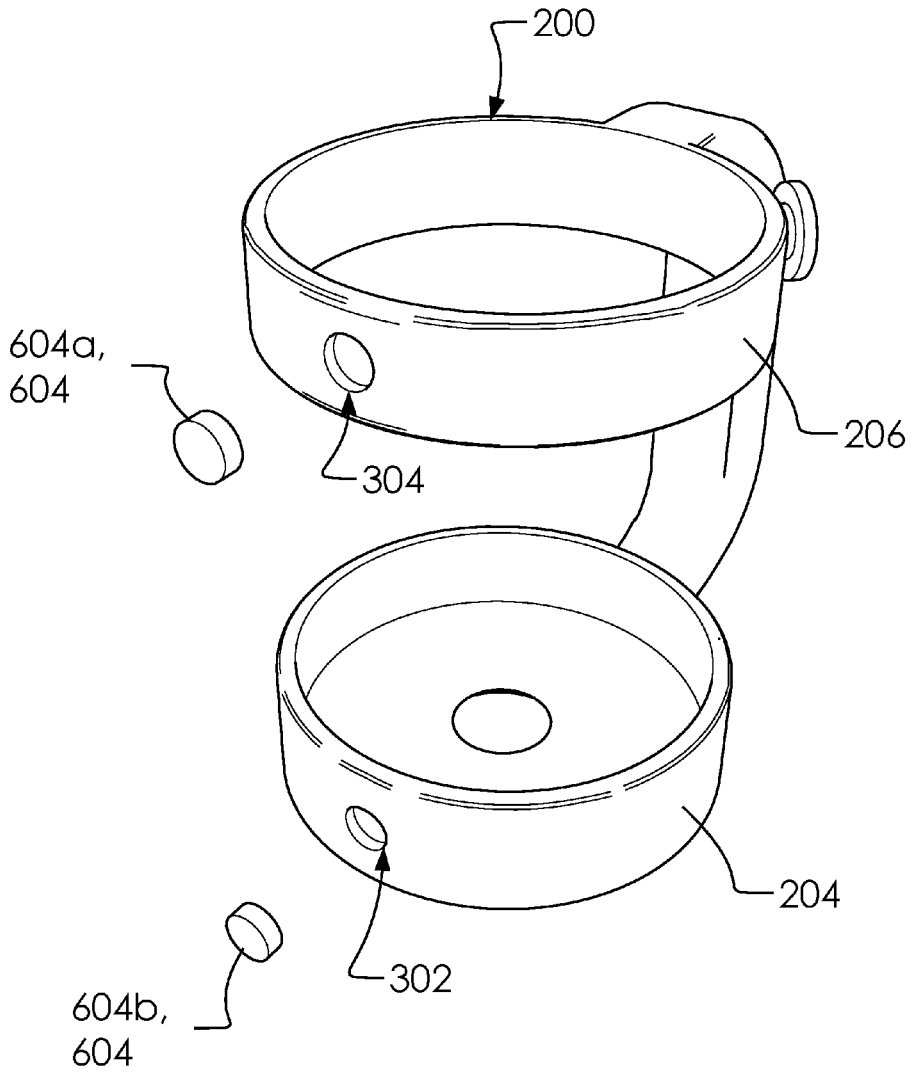
FIG. 12 illustrates a perspective overview view of a beverage holder 100 exploded.

FIG. 12 illustrates a perspective overview view of a beverage holder 100 exploded.

In one embodiment, said one or more sockets 1202 can comprise said first socket 1202*a* and said second socket 1202*b*.

In one embodiment, said one or more magnets 1204 can comprise said first magnet 1204*a* and said second magnet 1204*b*.

In one embodiment, said container portion 200 can comprise a sockets as shown.

Figure 13:
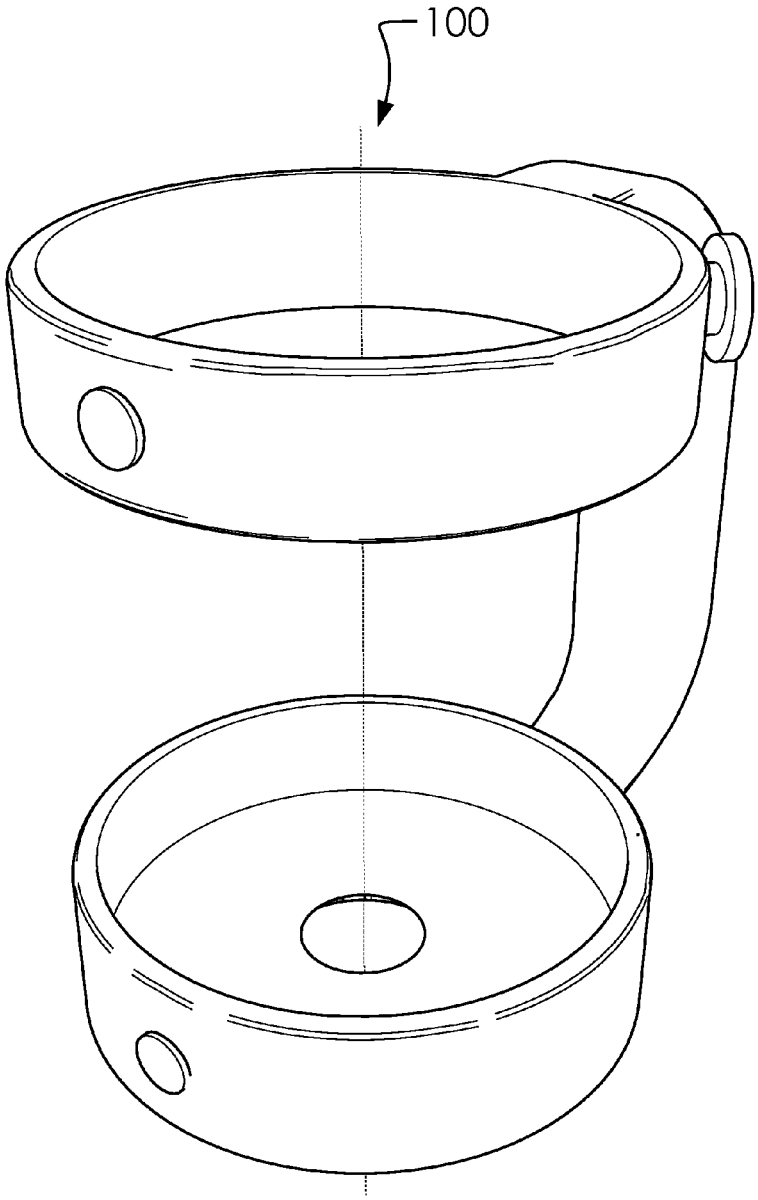
FIG. 13 illustrates a perspective overview view of a beverage holder 100 assembled.

FIG. 13 illustrates a perspective overview view of a beverage holder 100 assembled.

In one embodiment, said embedded magnets can be molded into said beverage holder 100 with no portion of said embedded magnets exposed outside of said container portion 200 and/or said container 1200 (not illustrated).

Figure 14A:
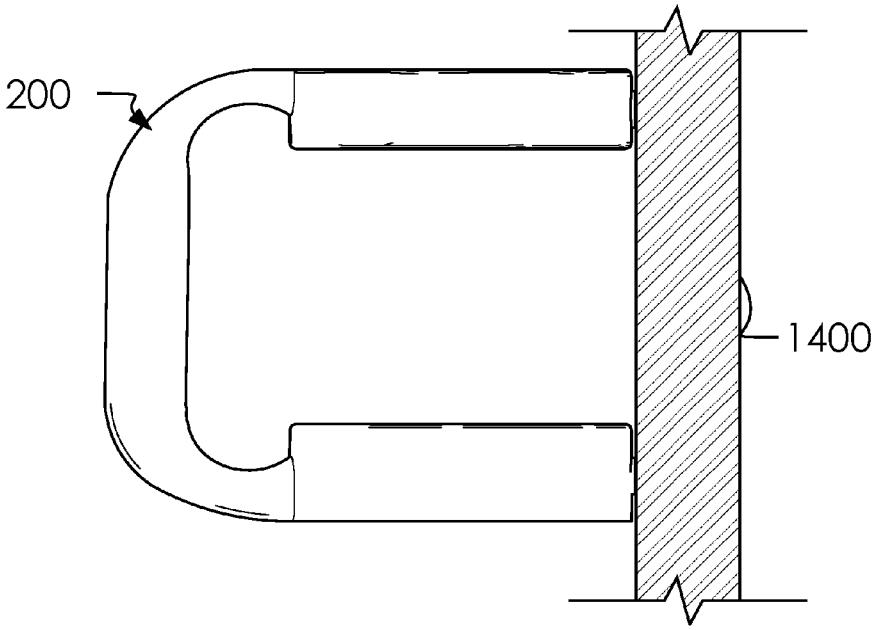
FIGS. 14A and 14B illustrate an elevated front side view of a beverage holder 100 stuck to a cross-section view of a wall 1400 and with a plurality of said cap 226 attached to said one or more magnets 604.
Figure 14B:
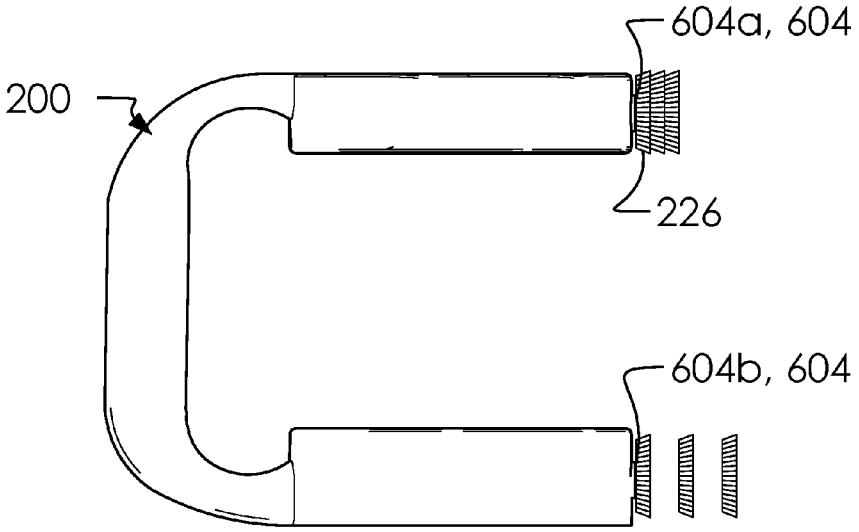

FIGS. 14A and 14B illustrate an elevated front side view of a beverage holder 100 stuck to a cross-section view of a wall 1400 and with a plurality of said cap 226 attached to said one or more magnets 604.

In one embodiment, said embedded magnets and/or said/ 604 can be attached substantially across from said handle portion 208 such that when said beverage holder 100 is selectively attached to a ferromagnetic surface (such as a metal appliance) then said handle portion 208 is accessible and convenient for removing said beverage holder 100 for such a surface.

In one embodiment, a plurality of said cap 226 can attach to said one or more magnets 604.

In one embodiment, said one or more magnets 604 can attach said beverage containment 200 to a ferromagnetic material such as said wall 1400 and/or a plurality of said cap 226. In one embodiment, said plurality of said cap 226 can be held on said beverage containment 200 as an accounting of how many drinks a user has consumed.

Figure 15A:
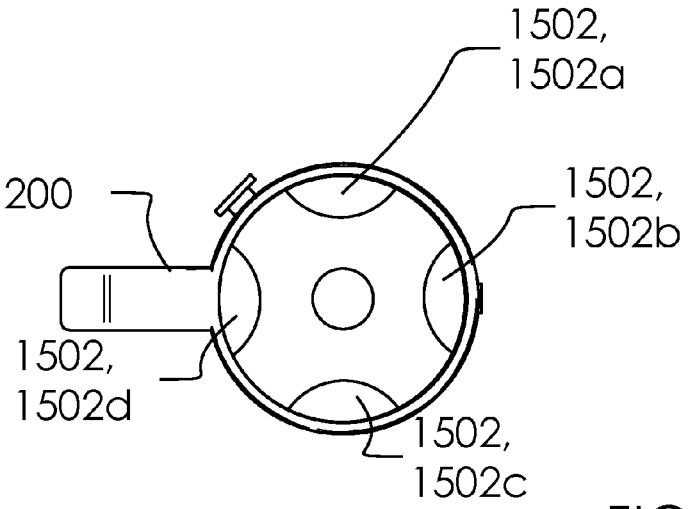
FIGS. 15A and 15B illustrate an elevated top view said beverage containment 200 with a one or more securing tabs 1502.
Figure 15B:
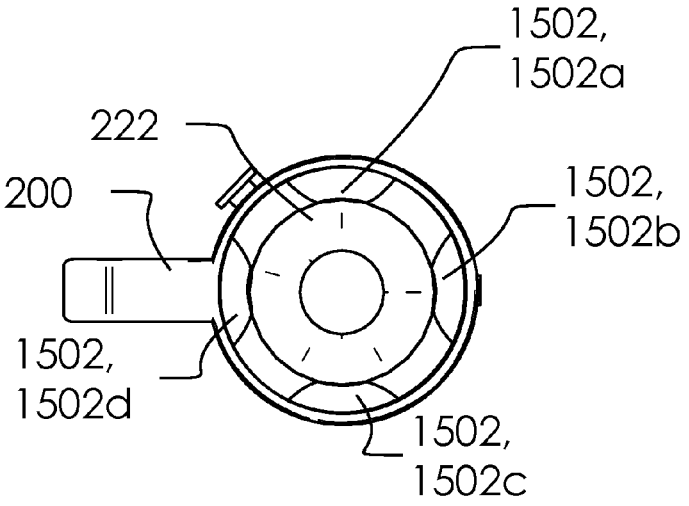

FIGS. 15A and 15B illustrate an elevated top view said beverage containment 200 with a one or more securing tabs 1502.

Said one or more securing tabs 1502 can comprise a first tab 1502*a*, a second tab 1502*b*, a third tab 1502*c* and a fourth tab 1502*d*. In one embodiment, said one or more securing tabs 1502 can secure said beverages 222 within said beverage containment 200 so that it will prevent lateral and forward movement. Said one or more securing tabs 1502 can comprise flexible or spring loaded materials such as those used in cup holders, as is known in the art.

In one embodiment, said beverage containment 200 can accommodate a beverage insulator such as a Koozie™.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A beverage holder configured for selectively holding a beverage comprising:

said beverage holder comprising a beverage containment;

said beverage containment comprises a base portion, an upper retainer portion and a handle portion;

said base portion and said upper retainer portion comprise a round sidewall having an internal diameter being larger than an external diameter of a beverage;

said base portion comprises a bottom surface configured to receive and hold a bottom portion of said beverage;

said upper retainer portion and said base portion are aligned along a vertical axis such that when said beverage is held within said beverage containment it is held upright along said vertical axis;

said upper retainer portion and said base portion are connected to one another with said handle portion;

said handle portion extends outward away from said vertical axis so as to enable a user to grip said beverage holder with said handle portion;

said beverage holder further comprises a clip button and a clip;

said clip button is attached at an exterior wall of said upper retainer portion;

said clip button selectively attaches to said clip;

said clip is configured to selectively attach to an object and allows said beverage holder to selectively attach to said object;

said beverage holder is configured to pivot on said clip button with said clip while attached to a user with said clip;

said clip comprises a belt clip configured to selectively attach to a belt of a user and thereby selectively hold said beverage holder to said belt of said user;

said round sidewall of said upper retainer portion wraps completely around an upper portion of said beverage; and said round sidewall prevents said beverage from slipping out of said beverage holder at an angle perpendicular to said vertical axis; said beverage containment further comprises a twist-off socket; said twist-off socket is round-shaped and comprises a substantially similar internal diameter to an external diameter of a cap of said beverage; and said twist-off socket is configured to receive and remove a cap from said beverages by: inserting a portion of said cap into said twist-off socket, turning said beverage around said vertical axis so as to loosen said cap from said beverage, preventing said cap from turning with said beverage, and removing said cap from said beverage; said twist-off socket comprises a plurality of cap teeth arranged around said internal diameter of said twist-off socket; said base portion further comprises a drain aperture configured to drain a fluids from within said beverage containment; said drain aperture is arranged about said vertical axis to ensure that said fluids are drained at a central location within said beverage containment; and said twist-off socket is located around the perimeter of said drain aperture in said base of said beverage holder.

2. The beverage holder of claim 1 wherein:

said handle portion comprises a "C" shape with a first end and second end;

said first end is attached to said upper retainer portion; and said second end is attached to said base portion.

3. The beverage holder of claim 1 wherein:

said base portion further comprises a drain aperture configured to drain a fluids from within said beverage containment.

4. The beverage holder of claim 3 wherein:

said drain aperture is arranged about said vertical axis to ensure that said fluids are drained at a central location within said beverage containment.

5. The beverage holder of claim 1 wherein:

said beverage holder comprises a one or more magnets configured to selectively attach said beverage holder to a ferromagnetic surface.

6. The beverage holder of claim 1 wherein:

said beverage holder further comprises a pry plate;

said pry plate is located in a lower portion of said beverage containment; and said pry plate is configured to receive a portion of a cap or a can tab of said beverage and enable a user to pry open said beverage.

7. The beverage holder of claim 6 wherein:

said pry plate is attached below said handle portion.

8. A beverage holder configured for selectively holding a beverage comprising:

said beverage holder is configured to selectively hold a beverage;

said beverage holder further comprises a twist-off socket;

said twist-off socket is round-shaped and comprises an internal diameter being substantially similar to an external diameter of a cap of said beverage; and said twist-off socket is configured to receive and remove a cap from said beverages by:

inserting a portion of said cap into said twist-off socket, turning said beverage around a vertical axis so as to loosen said cap from said beverage, preventing said cap from turning with said beverage, removing said cap from said beverage;

said twist-off socket comprises a plurality of cap teeth being arranged around said internal diameter of said twist-off socket;

said twist-off socket further comprises a raised lower rim configured to surround said cap and press a portion of said plurality of cap teeth into said cap;

said twist-off socket is embedded into a bottom surface of said beverage holder; and said beverage holder further comprises a drain aperture in a bottom surface;

said beverage holder holds a portion of said beverage on said bottom surface;

said twist-off socket comprises a lower portion of said drain aperture.

9. The beverage holder of claim 8 wherein:

said twist-off socket further comprises a grab being magnetic so as to hold said cap once said beverage is detached from said cap;

said base portion further comprises a drain aperture configured to drain a fluids from within said beverage containment;

said drain aperture is arranged about said vertical axis to ensure that said fluids are drained at a central location within said beverage containment; and said twist-off socket is located around the perimeter of said drain aperture in said base of said beverage holder.

10. A beverage holder configured for selectively holding a beverage comprising:

said beverage holder comprising a beverage containment;

said beverage holder comprises a two or more magnets configured to selectively attach said beverage holder to a ferromagnetic surface;

said two or more magnets comprise a first magnet and a second magnet;

said beverage containment comprises a first magnet aperture and a second magnet aperture;

said first magnet is embedded into said first magnet aperture;

said second magnet is embedded into said second magnet aperture;

said beverage containment comprises a base portion, an upper retainer portion and a handle portion;

said base portion and said upper retainer portion comprise a round sidewall having an internal diameter being larger than an external diameter of a beverage;

said base portion comprises a bottom surface configured to receive and hold a bottom portion of said beverage;

said upper retainer portion and said base portion are aligned along a vertical axis such that when said beverage is held within said beverage containment it is held upright along said vertical axis;

said upper retainer portion and said base portion are connected to one another with said handle portion;

said handle portion extends outward away from said vertical axis so as to enable a user to grip said beverage holder with said handle portion;

said first magnet aperture is in said base portion;

said second magnet aperture is in said upper retainer portion;

said round sidewall of said upper retainer portion wraps completely around an upper portion of said beverage; and said round sidewall prevents said beverage from slipping out of said beverage holder at an angle perpendicular to said vertical axis;

said handle portion and said two or more magnets are configured radially 180 degrees from one another relative to said vertical axis; said beverage containment further comprises a twist-off socket; said twist-off socket is round-shaped and comprises a substantially similar internal diameter to an external diameter of a cap of said beverage; said twist-off socket is configured to receive and remove a cap from said beverages by: inserting a portion of said cap into said twist-off socket, turning said beverage around said vertical axis so as to loosen said cap from said beverage, preventing said cap from turning with said beverage, and removing said cap from said beverage; said twist-off socket comprises a plurality of cap teeth arranged around said internal diameter of said twist-off socket; and said internal diameter of said twist-off socket defines a drain aperture in the beverage containment.

* * * * *